US008316464B2

(12) United States Patent
Hersh

(10) Patent No.: US 8,316,464 B2
(45) Date of Patent: Nov. 27, 2012

(54) CONVERTIBLE SWIMWEAR

(76) Inventor: Stephanie Hersh, Lake Worth, FL (US)

( * ) Notice: Subject to any disclaimer, the term of this patent is extended or adjusted under 35 U.S.C. 154(b) by 0 days.

(21) Appl. No.: 13/242,814

(22) Filed: Sep. 23, 2011

(65) Prior Publication Data

US 2012/0036610 A1 Feb. 16, 2012

Related U.S. Application Data

(62) Division of application No. 12/206,875, filed on Sep. 9, 2008, now Pat. No. 8,051,496.

(51) Int. Cl.
*A41D 7/00* (2006.01)

(52) U.S. Cl. ..... 2/67

(58) Field of Classification Search ..... 2/67, 115, 2/75, 80, 111, 108
See application file for complete search history.

(56) References Cited

U.S. PATENT DOCUMENTS 1,214,893 A * 2/1917 Butler ..... 2/85
1,969,333 A 8/1934 Steuer
2,022,621 A 11/1935 Ide
2,033,065 A 3/1936 Galligan
2,090,076 A 8/1937 Siegel
2,183,380 A 12/1939 Hurt
D136,860 S 12/1943 Walker
2,521,020 A 9/1950 Prescott
2,632,177 A 3/1953 Bigger
3,166,076 A 1/1965 Brown
3,185,156 A 5/1965 Steinberger
3,327,714 A 6/1967 Steinberger
3,654,630 A 4/1972 Block
3,740,765 A 6/1973 Delplace
4,154,249 A 5/1979 Darring
4,301,545 A 11/1981 Camarena
4,656,669 A 4/1987 Beard
4,773,101 A * 9/1988 Kapp et al. ..... 2/69.5
4,815,145 A 3/1989 Chow
4,853,977 A 8/1989 Foreman
4,999,848 A 3/1991 Oney
5,163,182 A 11/1992 Fiveash
5,315,712 A 5/1994 McTaggart
5,331,685 A 7/1994 Belgard
5,367,709 A 11/1994 Teasley
5,398,343 A 3/1995 Kuracina
5,678,246 A 10/1997 Cooley et al.
5,894,600 A 4/1999 Chenefront
6,009,556 A 1/2000 Nenninger
6,016,569 A 1/2000 Everett et al.
6,035,439 A 3/2000 Chin
6,185,741 B1 2/2001 Kehoe
6,223,352 B1 5/2001 Watlington
6,240,560 B1 6/2001 DeCaro
(Continued)

*Primary Examiner* — Alissa L Hoey
(74) *Attorney, Agent, or Firm* — McHale & Slavin, P.A.

(57) ABSTRACT

Convertible swimwear comprising a top piece and extendable bottom piece; the top piece having a plurality of fasteners along the lower portion thereof and the extendable bottom piece having a plurality of corresponding fasteners along the upper edge thereof to be releasably secured to the fasteners on the lower portion of the top piece. The position of the fasteners may be reversed. The bottom piece further includes a string component secured on the upper edge of the bottom piece, where upon releasing of the respective fasteners the string component is pulled away from the lower edge of the bottom piece bringing the upper edge of the bottom piece substantially close to said lower edge of the bottom piece and thereby rolling, folding or scrunching the upper edge of the bottom piece to effectively convert a one piece to two piece style bathing suit.

1 Claim, 2 Drawing Sheets

U.S. PATENT DOCUMENTS

| | | | |
|---|---|---|---|
| 6,859,944 | B2 | 3/2005 | Kim |
| 7,077,720 | B2 | 7/2006 | Schneider et al. |
| 7,181,773 | B1 | 2/2007 | Piraka |
| D544,678 | S | 6/2007 | Fitzgerald |
| 7,260,852 | B2 | 8/2007 | Sheetz |
| 7,340,780 | B2 | 3/2008 | Levy |
| 2006/0031976 | A1 | 2/2006 | Nwawka |
| 2007/0266472 | A1 | 11/2007 | DuFaux |

* cited by examiner

CONVERTIBLE SWIMWEAR

CROSS REFERENCE TO RELATED APPLICATIONS

This application is a division of U.S. patent application Ser. No. 12/206,875, filed Sep. 9, 2008, now U.S. Pat. No. 8,051,496 entitled CONVERTIBLE SWIMWEAR, the entirety of which is incorporated herein by reference.

FIELD OF THE INVENTION

This invention relates generally to bathing garments and, more particularly, to convertible swimwear capable of converting from a one piece swimsuit to a two piece swimsuit.

BACKGROUND OF THE INVENTION

Women's swimwear has evolved over time. While women's swimwear may have originated for use in bathing spas, swimwear is now used for sunbathing as well as swimming. Starting with bloomers and stockings, swimwear migrated into one piece style bathing suits. The one piece style bathing suits became the generally accepted swimwear and thereafter began a trend of creating swimwear that was lighter and briefer. The desire for greater exposure while wearing swimwear created the two piece style bathing suits.

Two piece bathing suits, also known as bikinis, allow women to have more of their bodies exposed for tanning purposes. Unfortunately, bikinis expose so much skin that a woman can easily sunburn. Additionally, a two piece bathing suit may not be practical for active sports because they offer little coverage of the women's body and pose the threat of disrobing.

There have been various attempts to design swimwear which is interchangeable from a one piece to a two piece style bathing suit which combine fashion and function. For instance, U.S. Pat. No. 4,301,545, "Adjustable Swimsuit" includes an adjustable swimsuit comprising an upper piece and a lower piece, the upper piece including a pair of cups and an intermediate connector section between the cups, with the connector including a first connector component. The lower piece includes a connector member with a second connecting component for connection to the first connecting component. The first connector component and the second connector member are fastened to one another in an adjustable fashion using string or ribbon, and the upper piece connecting section and lower piece connecting member are configured to cover selected portions of the wearer's body when the first connector component and the second connector component are connected to one another. The connecting components are concealable in the upper and lower pieces of the bathing suit, respectively, when not in use. The connecting components are tucked into the swimsuit upper and lower piece when the wearer desires to wear a two piece swimsuit. However, because the lower and upper pieces are fitted against the wearer's skin when the wearer tucks in the respective connecting component within its respective piece it protrudes outwardly creating an unfashionable look and furthermore it may also be uncomfortable for the wearer as a connecting component is pressed up against the wearer's skin by the tight-fitting upper and lower pieces.

U.S. Pat. No. 4,656,669, "Versatile Bathing Suit" provides a two-piece bathing suit having an upper bra section and a lower panty section. The panty section comprises at least one pouch disposed in an internal area of the panty. The pouch can contain various bathing suit materials for complementing the bathing suit ensemble. One such material is a frontal piece for covering the abdomen. This piece attaches underneath the bra and panty sections, and effectively converts the two-piece appearance into a one-piece look. Unfortunately, this extra material portion must be inconveniently carried by the wearer at all times that the swimsuit is in a two piece style bathing suit.

U.S. Pat. No. 4,815,145, "Convertible Bathing Suit" comprising a top portion having securing means disposed along at least a portion of the lower edge thereof; a bottom portion having securing means secured along at least a portion of the upper edge thereof; and a midriff portion having securing means disposed along at least a portion of its upper and lower edges corresponding to the securing means of said top portion and bottom portion, respectively, whereby the upper edge of said midriff portion can be attached to the lower edge of said top portion, and the lower edge of said midriff portion can be attached to the upper edge of said bottom portion to form a one-piece style bathing suit or said midriff portion can be detached from said top portion and said bottom portion to form a two piece type bathing suit. Again, this extra material portion must be inconveniently carried by the wearer at all times that the swimsuit is in a two piece style bathing suit.

U.S. Pat. No. 6,185,741 B1, "Convertible Ladies Swimwear" provides a convertible ladies' swimsuit that can be changed from a one piece swimsuit into either a two piece tank-top style swimsuit or two piece bikini style swimsuit for purposes such as, but not limited to, tanning or using the restroom. The swimsuit has a top piece and a separate bottom piece that may be attached to each other along the top edge of the bottom piece and the bottom edge of the top piece, using any of a number of attachment or fastening means such as snaps, Velcro® (hook and loop components), or any other appropriate fastening means, to form a one piece swimsuit. The top piece can be unfastened from the bottom piece to allow the wearer to conveniently use the bathroom. The lower region of the top piece can also be unfastened from the bottom piece, folded upward, either under or over the lower region of the top piece, and fastened behind the wearer's back to create a tank top style or a bikini type two piece swimsuit. The lower region of the top piece can alternatively be folded up completely over the front of the swimsuit and secured behind the wearer's neck to create a bikini style swimsuit, which allows for complete sunning of the midriff. Unfortunately, the extra material portion is either tucked into the top piece creating an unfashionable look or it is fastened behind the wearer's back or neck in effect creating less area of exposure for tanning purposes which the two piece attempts to accomplish.

While these prior arts may be suitable for the particular purpose to which they address, these prior arts would not be suitable for the purposes of the present invention as heretofore described. Alleviating the existing problems of having to retain and carry a midriff portion when not using the swimsuit as a one piece style or not having an unsightly, unfashionable connecting component protruding from the inside of the lower or upper piece of a two style bathing suit when tucked into its respective piece. As a consequence of these aforementioned problems, it is an objective of the present invention to provide a convertible swimwear having removably attachable top and bottom piece for converting the swimwear from a one piece to a two piece style bathing suit that is fashionable and functional.

SUMMARY OF THE INVENTION

The objective of this invention is to provide a convertible swimwear, comprising of a top piece having at least one fastener along either the upper portion or lower portion thereof; an extendable bottom piece having an upper edge, a lower edge, and an intermediate section, and the bottom piece including at least one corresponding fastener on the upper edge. The bottom piece includes at least one string component on at least one side of the bottom piece and the string component having a top portion, bottom portion, and intermediate portion. The string component comprising of a first and second end. The intermediate portion of the string component is disposed within the bottom piece between the proximate upper edge and lower edge of bottom piece. The top portion of the string component is secured to the upper edge of the bottom piece and the top portion of string component can be used to form a substantial loop on the upper edge of the bottom piece, the loop may be attached or separate. The bottom portion of the string component, specifically the first and second ends, extends outwardly from the lower edge of the bottom piece.

To form a one piece style bathing suit the fasteners on the upper edge of the bottom piece is releasably secured to the fasteners on the lower edge of the top piece thereby the bottom piece substantially covers the entire abdomen portion of a person. Upon release of the fasteners on upper edge of the bottom piece from the fasteners of the lower edge of the top piece, the upper edge is folded, rolled or scrunched together with the intermediate section thereby forming a two piece style bathing suit. Then contemporaneously the bottom portion of the string component is pulled away from the lower edge of the bottom piece bringing the upper edge of the bottom piece substantially close to the lower edge of said bottom piece, so the string component is not necessary to fold over the upper edge of the bottom piece. The first end of the string component is seeped through the loop on the top portion of the string component and secured to the second end to maintain the swimwear in a two piece style bathing suit and maintain the scrunch between the upper edge and intermediate section of the bottom piece. It should be noted that the string need not be tied through the loop, but it is suggested.

Accordingly, it is an objective of the present invention to provide convertible swimwear which allows a wearer to effectively have a one piece style bathing suit for sport activities such as diving, swimming, skiing, and yet be convertible to a two piece style bathing suit for sun-tanning purposes, restroom purposes, or the like.

It is a further objective of the present invention to provide convertible swimwear where the top and bottom piece are releasably secured by any number of attachment or fastening devices such as snaps, buttons, Velcro® (hook and loop component), or any other appropriate fastening devices to form a two piece to a one piece style bathing suit.

It is an additional objective of the present invention to provide convertible swimwear having a decorative cover flap extending overtop of the fasteners to mask the fasteners appearance, the fasteners may be placed under or over on the cover flap, also as a functional decoration as well.

It is an additional objective of the present invention to provide convertible swimwear having a string component to secure and maintain the upper edge of the bottom piece in close proximity to the lower edge of the bottom piece.

It is another additional objective of the present invention to provide convertible swimwear where the upper edge of the bottom piece is rolled, folded, or scrunched relative to the intermediate section of the bottom piece and then secured by a string component to secure and maintain the upper edge of the bottom piece is close proximity to the lower edge of the bottom piece.

It is a further objective of the present invention to provide convertible swimwear that the upper edge and intermediate portion of the bottom piece is capable of covering the entire abdomen portion of a wearer's body to conceal imperfections and flaws when in a one piece style bathing suit.

It is a further objective of the present invention to provide convertible swimwear where the back of the bottom piece may be low-cut to expose more of the wearer's back. The suit may be formed into either a high cut or low cut suit.

It is a further objective of the present invention to provide convertible swimwear constructed of an elastic water porous material.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Detailed embodiments of the instant invention are disclosed herein, however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Figure 1:
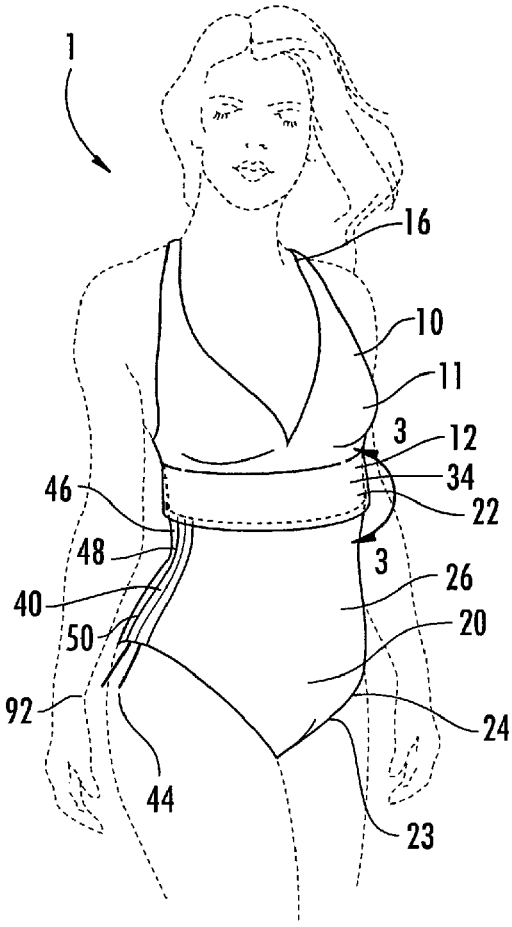
FIG. 1 is a front view of the convertible swimwear.
Figure 2:
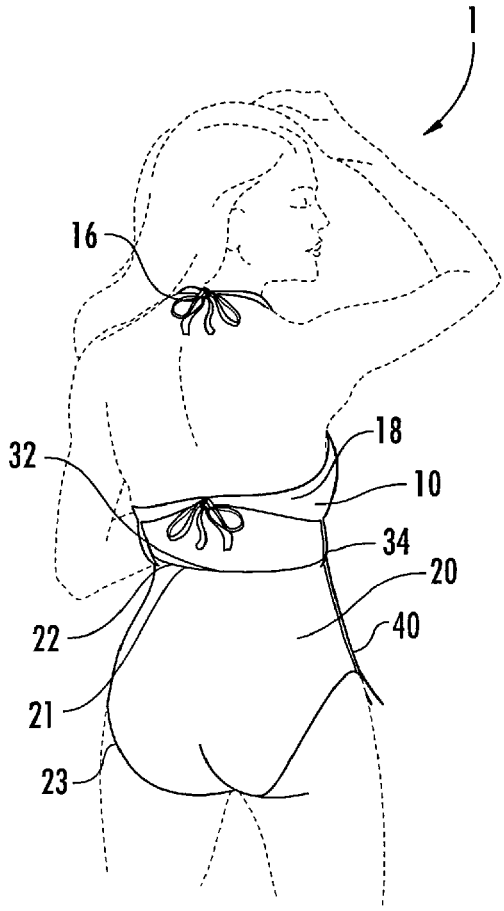
FIG. 2 is an back view of the convertible swimwear.
Figure 3:
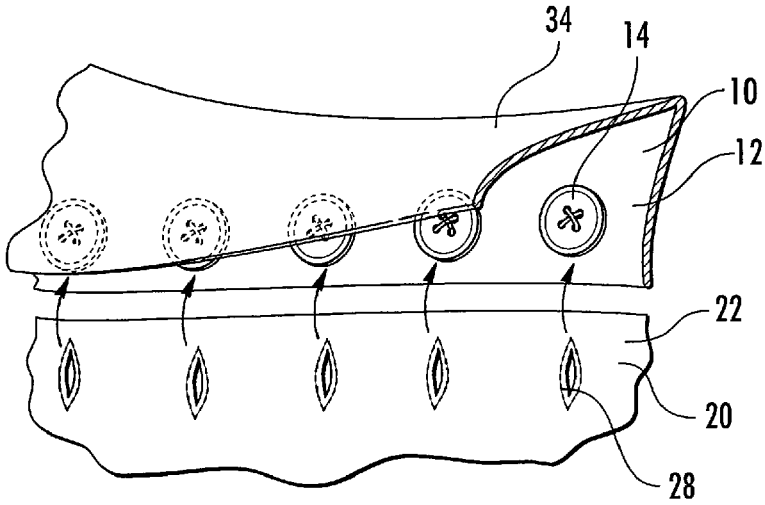
FIG. 3 is a enlarged front cut away view of the fastening device of the convertible swimwear.

Referring now to FIGS. 1-6, wherein like components are numbered consistently throughout, FIG. 1 illustrates the preferred embodiment of the convertible swimwear 1. The convertible swimwear 1 is constructed of expandable or elastic material, such as poly propylene by way of example only, so that the wearer is able to fittingly wear the convertible swimwear 1. The elastic material allows the convertible swimwear to be form-fitting to adapt to the contours on a user's body. The convertible swimwear 1 includes a top piece 10, bottom piece 20, cover flap 34, and a string component 40. The top piece 10 includes breast cups 11, a neck strap 16, a back strap 18, a cover flap 34, and along the lower portion 12 of the top piece 10 is a plurality of fasteners 14. FIG. 3 more aptly shows the fasteners 14 along the lower portion 12 of the top piece 10 and FIG. 2 more aptly shows the neck strap 16, back strap 18, and body opening 21. The cover flap 34 on the top piece 10 is located below the breast cups 11 and extends downwardly overtop the lower portion 12 of the top piece 10, thereby concealing the plurality of fasteners 14 along the lower portion 12 of the top piece 10.

The extendable bottom piece 20 of the convertible swimwear 1 includes an upper edge 22, lower edge 24, and intermediate section 26. The lower edge 24 includes two leg openings 23 and the upper edge 22 includes a body opening 21. The intermediate section 26 is capable of covering an entire abdomen section of a wearer when the convertible swimwear 1 is in a one piece style bathing suit. Along the upper edge 22 of the bottom piece 20 are a plurality of corresponding fasteners 28. The bottom piece 20 further includes at least one string component 40 on at least one side of the bottom piece 20. The bottom piece 20 is extendable from a one piece to a two piece style bathing suit, even without the use of fasteners 14 because of the form-fitting material used to construct the convertible swimwear 1. The extendable bottom piece 20 adapts to the contours of a user's body at the abdomen and just below the top piece 10. However, fasteners 14 provide a more secure method of keeping the bottom piece 20 attached to the top piece. For a one-piece style bathing suit. In a one piece style bathing suit, the intermediate section 26 conceals any imperfections, flaws, or the like that a wearer may have on their abdomen.

The string component 40 is one continuous elastic element having a first end 42 and second end 44. At least one string component 40 located on the side of the bottom piece 20 is contemplated, however, in the preferred embodiment two string components 40 on opposite sides of the bottom piece 20 is chosen. The string component 40 is integrated into the construction of the bottom piece 20 and includes a top portion 46, an intermediate portion 48, and a bottom portion 50. The intermediate portion 48 of the string component 40 is disposed of within the bottom piece 20, particularly extending from the lower edge 24 to proximate upper edge 22. The bottom portion 50 of the string component 40 extends outwardly from the lower edge of the bottom piece 20. The bottom portion 50 further includes the first end 42 and second end 44 of the string component 40. The first and second ends, 42 and 44, are not limiting and used for reference only. The top portion 46 of the string component 40 is secured to the upper edge 22 of the bottom piece 20 and forms a loop 52 (shown in FIG. 3) on the upper edge 22 of the bottom piece 20. The loop may be formed from part of the string or be formed separated.

Figure 6:
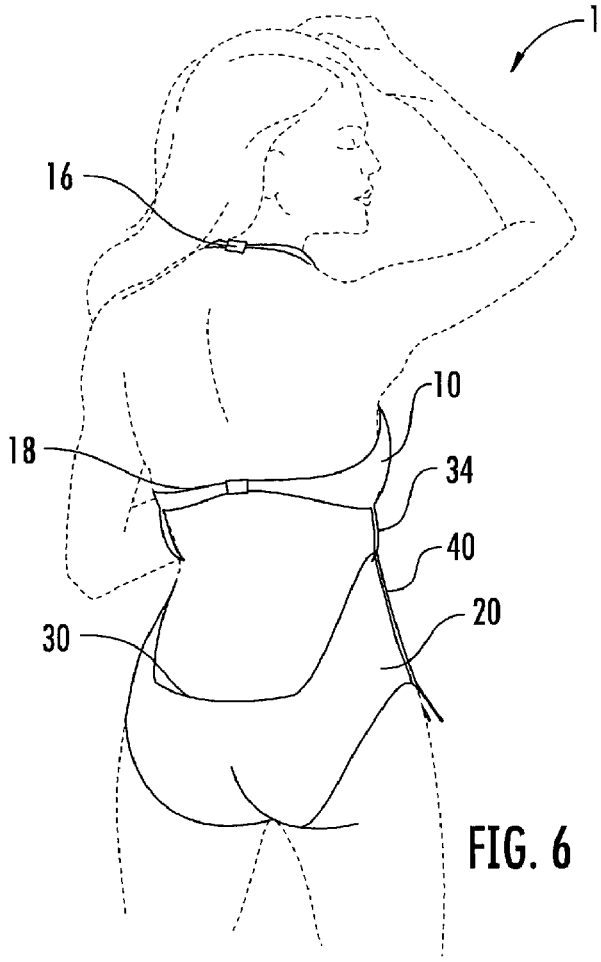
FIG. 6 is back view of an alternative embodiment of the convertible swimwear.

FIG. 2. illustrates the back view of the convertible swimwear 1. The bottom piece 20 is a full back 32, thereby effectively covering a substantial portion of the wearer's lower back. The top piece 10 includes a neck strap 16 and a back strap 18. The straps 16 and 18 shown are tie-knot fasteners, however it is contemplated that other fasteners may be used to secure to the top piece 10 to the wearer. By way of example, FIG. 6 shows clips as a fastening means for securing the top piece 10 to the wearer. Other fastening means such as Velcro®, buttons, or the like maybe used. Additionally, the cover flap 34 is shown to only extend around the front of the top piece 10.

FIG. 3 shows an enlarged front cut away view of the fastening device of the convertible swimwear 1. A plurality of fasteners such as buttons 14 along the lower portion of the top piece 10 are releasably secured to a plurality of corresponding fasteners such as button holes 28 along the upper edge 22 of the bottom piece 20. The convertible swimwear 1 is a one piece style bathing suit when the buttons 14 on the top piece 10 are secured unto the corresponding button holes 28 on the bottom piece 20. To convert to a two piece style bathing suit the buttons 14 are released from the button holes 28 allowing the bottom piece 20 to fall. Also shown in FIG. 3 is a cover flap 34. The cover flap 34 is attached to the top piece 10 just below the breast cups 11. The cover flap 34 extends across the front of the top piece 10 and downwardly overtop of the buttons along the lower portion 12 of the top piece 10 and corresponding button holes 28 along the upper edge 22 of the bottom piece 20. The cover flap 34 effectively conceals the buttons 14 and corresponding button holes 28 when secured. The cover flap 34 is an aesthetic feature to conceal the fasteners 14 and 28; because the convertible swimwear 1 must be pleasant to admire aside from its functional aspects. The fasteners may be placed above or below the cover flap. The fasteners may be buttons, snaps, zippers, VELCRO®, hooks and eyes, loops, and the like. The fasteners 14 are shown as a means to secure the bottom piece to the top piece. However, it is contemplated that the bottom piece 20 maybe of a form-fitting material whereby the upper edge 22 and intermediate section 26 on the bottom piece 20 adapt to the contours of a user's body as the upper edge 22 of the bottom piece is pulled toward the top piece 10.

Figure 4:
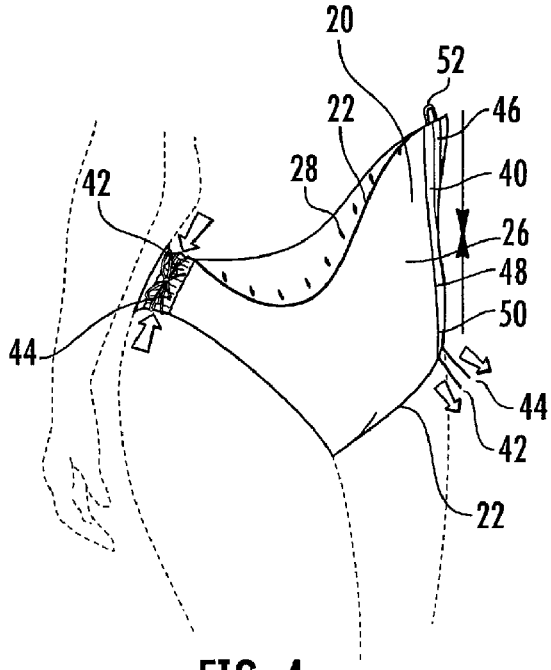
FIG. 4 is a front view of the bottom piece of the convertible swimwear.

FIG. 4 is an illustration of the bottom piece 20 when the button holes 28 are released from the buttons 14 on the top piece 10 and the upper edge 22 and intermediate section 26 of the bottom piece 20 falls downwardly. As discussed previously, the string component 40 is securely attached at the top portion 46 along the upper edge 22 of the bottom piece 20 and at the bottom portion the string component 40 extends outwardly from the lower edge 24 of the bottom piece 20. This construction allows the wearer to pull outwardly on the first end 42 and second end 44 of the string component 40 away from the upper edge 22, as illustrated by the arrows on the wearer's left hip, and thus draw the upper edge 22 near the lower edge 24 of the bottom piece 20, shown on the wearer's right hip, because the string component 40 is secured at the top portion 46 at the upper edge 22.

Figure 5:
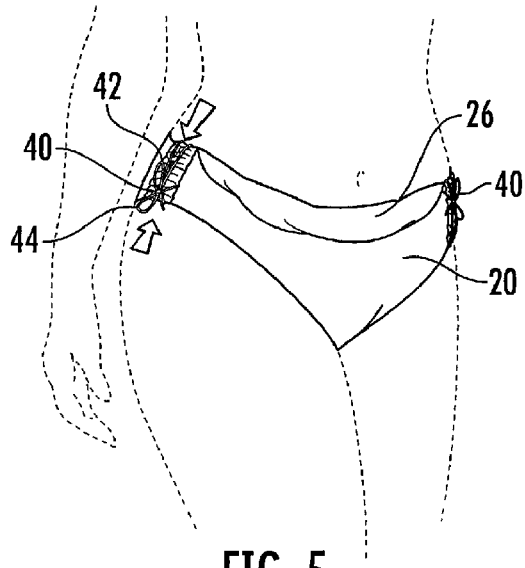
FIG. 5 is a front view of the rolled, folded or scrunched bottom piece of the convertible swimwear.

On FIG. 4, specifically on the wearer's right hip, and FIG. 5 illustrates the bottom piece 20 when fully converted into a two piece style bathing suit. Upon release of the buttons 14 from the button holes 28 and upon drawing the upper edge 22 substantially close to the lower edge 24 of the bottom piece 20 then one end, either first end 42 or second end 44 as they are convertible, of the string component 40 is extended and seeped through the loop 52 on the upper edge of the bottom piece 20. Once seeped through the loop 52 the first end 42 of the string component 40 is drawn downwardly and secured to the second end of the string component 40. The wearer rolls, folds or scrunches up the upper edge 22 together with the intermediate section 26 of the bottom piece 20. To scrunch the upper edge 22 relative to the intermediate section 26 is to crunch, crumple, fold or roll. Contemporaneously the user draws the upper edge 22 substantially close to the lower edge 24 of the bottom piece 20 using the string component 40. Since the string component is securely attached to the upper edge 22 of the bottom piece 20, when the upper edge 22 and intermediate section 26 are scrunched together they are maintained in place when the ends of the string component are secured together once seeped through the loop 52. This function provides an aesthetic value as the convertible swimwear 1 is converted to a two piece style bathing suit.

FIG. 6 shows alternative embodiments of the convertible swimwear 1, specifically the low back 30 on the bottom piece 20, which exposes more of the back of the wearer. Additionally, the neck strap 16 and back strap 18 are shown with clips as a means of fastening the top piece 10 so that it may fit snuggly about the wearer.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. Convertible swimwear comprising:

a top piece constructed from a single piece of material having a pair of breast cups defining a front of said top piece, each said breast cup supported by a neck strap of a length allowing securement of a distal end of each neck strap about the neck of an individual and a back strap having a length allowing securement of a distal end of each back strap about the back of the individual;

a cover flap attached to said top piece and extending across the front of the top piece beneath said breast cups, said cover flap having a distal edge extending downwardly from said breast cups;

a bottom piece constructed from a form fitting elastic material, said bottom piece having an upper edge, a lower edge, and an intermediate section, said upper edge of said bottom piece placed beneath said cover flap of said top piece to assimilate a one piece style bathing suit with said intermediate section covering the abdomen portion of the individual wherein said upper edge of said bottom piece can be drawn to said lower edge of said bottom piece thereby forming a two piece style bathing suit, at least one string component on at least one side of said bottom piece, said string component having a top portion, a bottom portion, and an intermediate portion; said intermediate portion of said string component disposed within said bottom piece between said upper edge and said lower edge of said bottom piece; said top portion of said string component secured to said upper edge of said bottom piece, said bottom portion of said string component extending outwardly from said lower edge of said bottom piece;

wherein said bottom portion of said string component includes a first end and a second end, said first end of said bottom portion extends through a loop of said top portion of said string component and is secured to said second end of said bottom portion of said string component whenever said upper edge and said lower edge of said bottom piece are substantially close to each other thereby maintaining said swimwear in said two piece style bathing suit, whereby said intermediate portion can be used in holding said intermediate portion in a rolled, folded or scrunched position.

* * * * *